US007585376B2

(12) United States Patent
Scheibel et al.

(10) Patent No.: US 7,585,376 B2
(45) Date of Patent: Sep. 8, 2009

(54) COMPOSITION CONTAINING AN ESTERIFIED SUBSTITUTED BENZENE SULFONATE

(75) Inventors: Jeffrey John Scheibel, Loveland, OH (US); Scott Leroy Cron, Fairfield, OH (US); Xinbei Song, Cincinnati, OH (US); Kevin Patric Christmas, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 140 days.

(21) Appl. No.: 11/588,712

(22) Filed: Oct. 27, 2006

(65) Prior Publication Data

US 2007/0105742 A1 May 10, 2007

Related U.S. Application Data

(60) Provisional application No. 60/730,957, filed on Oct. 28, 2005.

(51) Int. Cl.

| | |
|---|---|
| ***B08B 3/04*** | (2006.01) |
| ***C11D 1/22*** | (2006.01) |
| ***C11D 3/34*** | (2006.01) |
| ***C11D 3/37*** | (2006.01) |
| ***C11D 7/18*** | (2006.01) |

(52) U.S. Cl. ..... 134/42; 134/39; 8/137; 510/302; 510/346; 510/351; 510/357; 510/367; 510/426; 510/475; 510/495

(58) Field of Classification Search ..... 510/302, 510/346, 351, 357, 367, 426, 475, 495; 134/39, 134/42; 8/137

See application file for complete search history.

(56) References Cited

U.S. PATENT DOCUMENTS

| | | | | |
|---|---|---|---|---|
| 3,547,988 | A | | 12/1970 | Bean |
| 3,812,044 | A | | 5/1974 | Connor et al. |
| 3,864,286 | A | | 2/1975 | Anderson |
| 3,957,660 | A | | 5/1976 | Kablaoui et al. |
| 4,058,472 | A | | 11/1977 | Kablaoui |
| 4,595,736 | A | | 6/1986 | Patel |
| 4,687,592 | A | | 8/1987 | Collins et al. |
| 4,788,316 | A | * | 11/1988 | Thornthwaite et al. ..... 558/268 |
| 4,814,110 | A | | 3/1989 | Fong et al. |
| 4,964,870 | A | * | 10/1990 | Fong et al. ..... 8/111 |
| 5,622,996 | A | | 4/1997 | Fish |
| 5,834,525 | A | | 11/1998 | Fish |
| 6,065,130 | A | | 5/2000 | Glitho |
| 6,350,921 | B1 | | 2/2002 | Durairaj et al. |

FOREIGN PATENT DOCUMENTS

| | | | |
|---|---|---|---|
| CN | 1425646 | A | 12/2002 |
| JP | 48017643 | | 5/1973 |
| JP | 55047382 | A | 4/1980 |
| JP | 63258806 | A2 | 10/1988 |
| JP | 63258804 | A2 | 2/1990 |
| JP | 4164017 | | 6/1992 |
| JP | 6065130 | A2 | 3/1994 |
| JP | 9100494 | A2 | 4/1997 |
| WO | WO - 9605283 | | 2/1996 |
| WO | WO 2006/133773 | A1 | 12/2006 |

OTHER PUBLICATIONS

U.S. Appl. No. 11/588,457, filed Oct. 27, 2006, Song et al.

* cited by examiner

*Primary Examiner*—Brian P Mruk
(74) *Attorney, Agent, or Firm*—Stephen T. Murphy; Laura R. Grunzinger; Kim W. Zerby

(57) ABSTRACT

An esterified substituted benzene sulfonate, a method of making the same, a detergent composition comprising the same and a method of using the detergent composition.

13 Claims, No Drawings

COMPOSITION CONTAINING AN ESTERIFIED SUBSTITUTED BENZENE SULFONATE

CROSS REFERENCE TO RELATED APPLICATION

This application claims the benefit of Provisional U.S. Patent Application No. 60/730,957 filed Oct. 28, 2005.

FIELD OF THE INVENTION

The present invention relates to specified esterified substituted benzene sulfonate materials for use in detergent compositions and a method of making the specified esterified substituted benzene sulfonate materials.

BACKGROUND OF THE INVENTION

Phenylene mono and diesters peracid precursors are discussed in U.S. Pat. Nos. 4,964,870 and 4,814,110. The diester peracid precursors include ortho-, meta- and para-substituted phenylene diesters, which, when combined with a source of hydrogen proxide in aqueous solution create a peracid source. It is further discussed peracid precursors containing mixed chain lengths provides extremely proficient bleaching. These precursors are further discussed being combined with surfactants. A detergent composition containing a polyfunctionally-substituted aromatic acid sequestering agent is discussed in U.S. Pat. No. 3,812,044.

Anionic catechols have been discussed as being sequestering agents, or builders, in cleaning compositions. U.S. Pat. No. 3,864,286 discusses the use of disulfonated catechols as detergent builders and surfactants in heavy-duty detergent compositions. U.S. Pat. No. 3,812,044 discusses the use of a water soluble salt of a polyfunctionally-substituted aromatic acid compound as a sequestering agent in detergent compositions. U.S. Pat. No. 4,687,592 discusses a detergency builder system for detergent compositions having ether polycarboxylates, iron and manganese chelating agent (polyfunctionally-substituted aromatic chelating agents among others) and a polymeric polycarboxylate dispersing agent. An alkyl modification to a disulfonated catechol is discussed in U.S. Pat. No. 4,058,472 for the use of alkali metal and ammonium salts of sulfonated $C_{12}$-$C_{18}$ alkylcatechols as a surfactant component of detergent compositions.

Soil suspending polymers or dispersing agents have been utilized in laundry detergent applications. One type of soil these polymers are utilized for are clay soils. Clay soils comprise platelets that associate in face-to-face, edge-to-face or a mixture of the two orientations. The platelets contain aluminum ions ($Al^{3+}$), some ions being exposed along the edge of the platelet creating a positive charge density. Removal of the clay soils from the surfaces to which it is adhered is difficult to accomplish in relatively short time periods (under 1 hour) such as those found in standard laundry or dishwashing cycles. This is especially true at lower cleaning temperatures (60° C.). Soil suspending polymers do provide some removal of clay soils, however, such clay soils are often not completely removed from the surface. Therefore there still exists a need to improve clay soil removal from surfaces.

It has been surprisingly discovered that the combination of an esterified substituted benzene sulfonate materials, a hydrogen peroxide source, and a soil suspending polymer, provides improved clay soil cleaning. It has also surprisingly been discovered that the combination of esterified substituted benzene sulfonate materials, a hydrogen peroxide source, and a soil suspending polymer, provides bleached and improved plant-derived polyphenolic compound soil cleaning.

SUMMARY OF THE INVENTION

The present invention relates to a detergent composition comprising an esterified benzene sulfonate having the general structure:

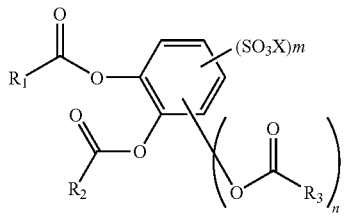

wherein $R_1$ is selected from hydrogen or a $C_1$-$C_{11}$ alkyl; $R_2$ is selected from hydrogen or a $C_1$-$C_{11}$ alkyl, $R_3$ is selected from hydrogen or a $C_1$-$C_{11}$ alkyl, m is selected from 1 or 2, n is selected from 0 to 3, and X is a suitable water soluble cation; a water soluble soil suspending polymer; and a hydrogen peroxide source.

The present invention further relates to a method of making an esterified benzene sulfonate and methods of using the same.

DETAILED DESCRIPTION OF THE INVENTION

As used herein "clay soil" means naturally-occurring particulates primarily made up of alumino-silicate of varying trace inorganic impurities and associated color-bodies including low levels of natural organic matter. Technical clay soils used for this work were obtained from commercial companies that supply stained fabrics to the industry (e.g. Empirical Manufacturing Company).

As used herein "plant-derived polyphenolic compound soil" means polyphenolic compounds such as tannins, anthocyanins, chlorophyll and other materials found in colored soils (e.g. wine, grape juice, tea and grass).

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Detergent Composition

The esterified substituted benzene sulfonate may be utilized in detergent compositions. The present compositions can be in any conventional form, namely, in the form of a liquid, powder, granules, agglomerate, paste, tablet, pouches, bar, gel, types delivered in dual-compartment containers, spray or foam detergents, premoistened wipes (i.e., the detergent composition in combination with a nonwoven material such as that discussed in U.S. Pat. No. 6,121,165), dry wipes (i.e., the detergent composition in combination with a nonwoven materials, such as that discussed in U.S. Pat. No.

5,980,931) activated with water by a consumer, and other homogeneous or multiphase consumer cleaning product forms.

The composition may also be utilized in laundry detergent compositions, dishwashing detergent compositions, car care compositions, for cleaning various surfaces such as hard wood, tile, ceramic, plastic, leather, metal, glass. This detergent composition could be also designed to be used in a personal care composition such as shampoo composition, body wash, liquid or solid soap and other detergent compositions. Generally a detergent composition will contain a surfactant or surfactant system and other optional components.

Esterified Substituted Benzene Sulfonate

The present invention relates to detergent composition comprising an esterified substituted benzene sulfonate having the general structure:

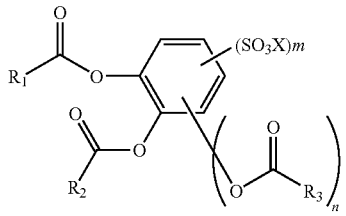

wherein $R_1$ is selected from hydrogen or a $C_1$-$C_{11}$ alkyl; $R_2$ is selected from hydrogen or a $C_1$-$C_{11}$ alkyl, $R_3$ is selected from hydrogen or a $C_1$-$C_{11}$ alkyl and X is a suitable water soluble cation. $R_1$ can be the same or different from $R_2$. $R_1$ and $R_2$ can be the same or different from $R_3$. n is selected from 0 to 3. m is selected from 1 to 3.

The esterified substituted benzene sulfonate may be selected as an esterified benzene sulfonate having the general structure:

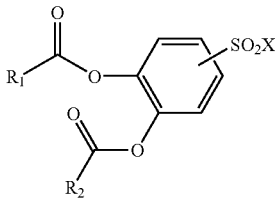

wherein $R_1$ is selected from hydrogen or a $C_1$-$C_{11}$ alkyl; $R_2$ is selected from hydrogen or a $C_1$-$C_{11}$ alkyl and X is a suitable water soluble cation. $R_1$ can be the same or different from $R_2$. One embodiment includes $R_1$ and $R_2$ being selected as $CH_3$ ($C_1$ alkyl), such as 1,2 di-acetoxy benzene-4 Na sulfonate. Another embodiment includes both $R_1$ and $R_2$ being selected as $C_9$ alkyl, such as 4-sodium sulfocatechol-dinonate. The sulfonate moiety may be substituted on the benzene ring on any of the 2-4 positions. In one embodiment shown below, the sulfonate moiety is located at the 4 position having X as a sodium cation.

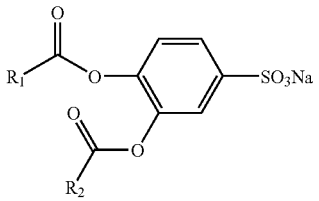

In another embodiment shown below, the esterified benzene sulfonate is selected to be a disulfonate having X as a sodium cation:

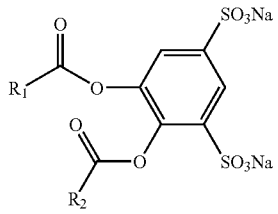

Another embodiment includes $R_1$ being selected as a $CH_3$ ($C_1$ alkyl) and $R_2$ being selected as a $C_9$ alkyl. Mixtures of the esterified benzene sulfonates may be utilized as well. In one embodiment a mixture of diesterified benzene sulfonates may be used wherein one diesterified benzene sulfonate where $R_1$ is selected as a $CH_3$ ($C_1$ alkyl) and $R_2$ is selected as a $C_9$ alkyl is mixed with a second diesterified benzene sulfonate where both $R_1$ and $R_2$ are selected as $C_9$ alkyl. Preferably the ester moieties are selected such that a functional material results when the esterified benzene sulfonate comes into contact with a hydrogen peroxide source.

In one embodiment, the esterified substituted benzene sulfonate is essentially free of catechol (1,2-benzenediol). Without being bound by a theory, it is believed that catechol may produce a skin irritation when present. As used herein, "essentially free" means less than about 3 wt %, less than about 2 wt %, less than about 1 wt % to 0 wt %, by weight of the esterified substituted benzene sulfonate of catechol being present.

Process of Making Esterified Benzene Sulfonate

The present invention further relates to a method of making a esterified benzene sulfonate comprising the steps of: (a) esterifying a cis-polyhydroxybenzene with a carboxylic acid or carboxilic acid derivative to form an esterified benzene; (b) sulfonating the esterified benzene to form an esterified benzene sulfonate acid; and (c) neutralizing the esterified benzene sulfonate acid to form an esterified benzene sulfonate. Carboxylic acid derivatives include but are not limited to acid halides, acid anhydrides and esters.

Cis-polyhydroxybenzene materials contain at least two cis-hydroxyl groups an may be selected from the group comprising catechol (1,2-dihydroxybenzene), pyrogallol (1,2,3-trihydroxybenzene), 1,2,4-benznetriol (1,2,4-trihydroxybenzene), and apinol (1,2,3,4-tetrahydroxybenzene).

Sulfonation may be done by any known method. Chlorosulfonic acid may be utilized as a sulfonating agent. See U.S. Pat. Nos. 3,812,044; 6,452,035, WO 01/05874 and WO 01/29112.

Neutralization may be done by any known method, but the neutralizing agent may be selected from the group comprising sodium methoxide, sodium hydroxide, sodium acetate and mixtures thereof. Sodium acetate may be selected for improved retention of esters during neutralization.

The following are non-limiting examples of synthesis methods making the esterified benzene sulfonates.

1) Synthesis of 1,2-Diacetoxybenzene-3,5-Di-(Sodium Sulfonate)

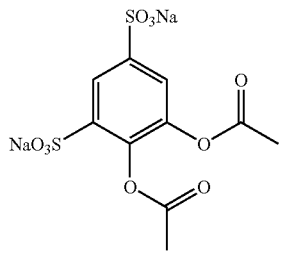

1,2-Dihydroxybenzene-3,5-Di-(Sodium Sulfoante) is prepared according to U.S. Pat. No. 3,771,379 example 1. 1,2-benzenediol ("Catechol") is disulfonated with concentrated sulfuric acid/oleum followed by subsequent neutralization with 50% sodium hydroxide and isolation of product. Esterification is accomplished by reflux a mixture of 1,2-Dihydroxybenzene-3,5,Di-(Sodium Sulfonate) (30.0 g, 95.5 mmole), acetic anhydride (157.2 g, 1.53 moles) and glacial acetic acid (150 ml) under positive nitrogen pressure for six (6) hours to yield a homogenous solution. Cool the solution and add dropwise the homogenous solution with vigorous stirring at 20° C. to diethyl ether (1 L) to yield a white precipitate. Cool the resultant in a freezer (0° C.) 4 hours. Collect the precipitate by filtration, rinse twice with 100 ml diethyl ether and dry to yield about 37.76 g (99.9% yield) of 1,2-Diacetoxybenzene-3,5-Di-(Sodium Sulfonate).

2) Synthesis of 1,2-Dinonoxybenzene-3,5-Di-(Sodium Sulfonate)

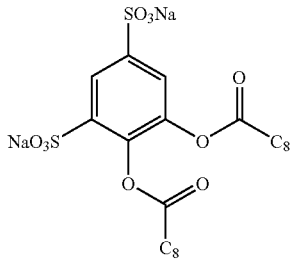

Stir a mixture of 4,5-Dihydroxy-m-benzenedisulfonic Acid (30.0 g, 95.5 mmole), nonanoic anhydride (228.0 g, 0.76 moles) and anhydrous DMSO (250 ml) at 120-130° C. under a nitrogen blanket for 24 hours yielding a homogenous solution. Cool the solution and add dropwise the homogenous solution with vigorous stirring at 20° C. to diethyl ether (1.5 L) to yield a white precipitate. Cool the resultant in a freezer (0° C.) for 4 hours. Collect the precipitate is by filtration, rinse twice with 100 ml diethyl ether and dry.

3) Synthesis of 1-Acetoxy-2-Nonoxybenzene-3,5-Di-(Sodium Sulfonate)

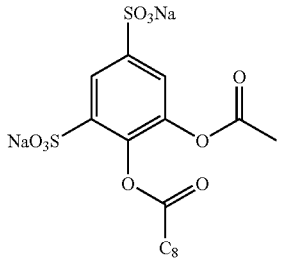

The following procedure affords a mixture of 1,2-Diacetoxybenzene-3,5-Di-(Sodium Sulfonate), 1,2-Dinonoxybenzene-3,5-Di-(Sodium Sulfonate), 1-Nonoxy-2-Acetoxybenzene-3,5-Di-(Sodium Sulfonate) and 1-Acetoxy-2-Nonoxybenzene-3,5-Di-(Sodium Sulfonate) with the mixed ester variants being the primary product.

Stir a mixture of 4,5-Dihydroxy-m-benzenedisulfonic Acid (30.0 g, 95.5 mmole), nonanoic anhydride (42.8 g, 143.3 mmoles), acetic anhydride (14.7 g, 143.3 mmole) and anhydrous DMSO (100 ml) at 120-130° C. under a nitrogen blanket for 24 hours yielding a homogenous solution. Cool the solution and add dropwise the homogenous solution with vigorous stirring at 20° C. to diethyl ether (1 L) yielding a white precipitate. Cool the resultant in freezer (0° C.) for 4 hours. Collect the precipitate by filtration, rinse twice with 100 ml diethyl ether and dry.

Hydrogen Peroxide Source

The esterified benzene sulfonate may be utilized in detergent composition which also comprises a source of hydrogen peroxide that triggers the separation of the esterified benzene sulfonate into the corresponding $C_2$-$C_{12}$ carboxylic acid and 1,2-benzenehydroxy sulfonate. Suitable hydrogen peroxide sources include, but are not limited to percarbonate, perborate, persilicate, hydrogen peroxide adducts and hydrogen peroxide.

The triggering hydrogen peroxide source material, when present, comprises from about 0.5% to about 15%, by weight of the detergent composition. Certain embodiments of the detergent composition comprise from about 1% to about 10% of the hydrogen peroxide source. The hydrogen peroxide source material may be added to the detergent composition directly or it may be added in a form where early formation of peroxide and resulting premature separation of the esterified benzene sulfonates prevented or minimized, such as by adding the hydrogen peroxide source in an encapsulated form.

Soil Suspending Polymers

The composition comprises from about 0.01% to about 4% by weight of a soil suspending polymer selected from polyesters, polycarboxylates, saccharide based materials, modified celluloses, modified polyethyleneimines, modified hexamethylenediamine, branched polyaminoamines, modified polyaminoamides, hydrophobic polyamine ethoxylate polymers, polyamino acids, polyvinylpyridine N-oxide, N-vinylimidazole N-vinylpyrrolidone copolymers, polyvinylpyrrolidone, polyvinyloxazolidone, polyvinylimidazole and mixtures thereof. The degree of polymerization for these materials, which is most easily expressed in terms of weight average molecular weight, is not critical provided the material has the desired water solubility and soil-suspending power. Suitable polymers will also, generally, have a water solubility of greater than 0.3% at normal usage temperatures.

Polyesters

Polyesters of terephthalic and other aromatic dicarboxylic acids having soil release properties such as polyethylene terephthalate/polyoxyethylene terephthalate and polyethylene terephthalate/polyethylene glycol polymers, among other polyester polymers, may be utilized as the soil suspending polymer in the present composition.

High molecular weight (e.g., 40,000 to 50,000 M.W.) polyesters containing random or block ethylene terephthalate/polyethylene glycol (PEG) terephthalate units have been used as soil release compounds in laundry cleaning compositions. See U.S. Pat. Nos. 3,962,152, 3,959,230, 3,959,230 and 3,893,929. Sulfonated linear terephthalate ester oligomers are discussed in U.S. Pat. No. 4,968,451. Nonionic end-capped 1,2-propylene/polyoxyethylene terephthalate polyesters are discussed in U.S. Pat. No. 4,711,730 and nonionic-capped block polyester oligomeric compounds are discussed U.S. Pat. No. 4,702,857. Partly- and fully-anionic-end-capped oligomeric esters are discussed further in U.S. Pat. No. 4,721,580 and anionic, especially sulfoaroyl, end-capped terephthalate esters are discussed in U.S. Pat. Nos. 4,877,896 and 5,415,807.

U.S. Pat. No. 4,427,557, discloses low molecular weight copolyesters (M.W. 2,000 to 10,000) which can be used in aqueous dispersions to impart soil release properties to polyester fibers. The copolyesters are formed by the reaction of ethylene glycol, a PEG having an average molecular weight of 200 to 1000, an aromatic dicarboxylic acid (e.g. dimethyl terephthalate), and a sulfonated aromatic dicarboxylic acid (e.g. dimethyl 5-sulfoisophthalate). The PEG can be replaced in part with monoalkylethers of PEG such as the methyl, ethyl and butyl ethers.

Polyesters formed from: (1) ethylene glycol, 1,2-propylene glycol or a mixture thereof; (2) a polyethylene glycol (PEG) capped at one end with a $C_1$-$C_4$ alkyl group; (3) a dicarboxylic acid (or its diester); and optionally (4) an alkali metal salt of a sulfonated aromatic dicarboxylic acid (or its diester), or if branched polyesters are desired, a polycarboxylic acid (or its ester). The block polyester polymers are further discussed in U.S. Pat. No. 4,702,857. Poly(vinyl ester) hydrophobe segments, including graft copolymers of poly(vinyl ester), e.g., $C_1$-$C_6$ vinyl esters, preferably poly(vinyl acetate), grafted onto polyalkylene oxide backbones, commercially available under the tradenames of SOKALAN®, such as SOKALAN® HP-22, available from BASF, Germany may also be utilized.

U.S. Pat. No. 4,201,824, discloses hydrophilic polyurethanes having soil release and antistatic properties useful in detergent compositions. These polyurethanes are formed from the reaction product of a base polyester with an isocyanate prepolymer (reaction product of diisocyanate and macrodiol).

EP 0752468 B1 discloses a water-soluble copolymer providing soil release properties when incorporated in a laundry detergent composition, the copolymer comprising monomer units of poly(ethylene glycol) and/or capped poly(ethylene glycol) and monomer units of one or more aromatic dicarboxylic acids, characterized in that the copolymer comprises monomer units of poly(ethylene glycol) and/or capped poly (ethylene glycol); monomer units of one or more aromatic dicarboxylic acids wherein the aromatic is optionally sulphonated; and monomer units derived from a polyol having at least 3 hydroxyl groups, Polycarboxylates The present composition may comprise a polycarboxylate polymer or co-polymer comprising a carboxylic acid monomer. A water soluble carboxylic acid polymer can be prepared by polyimerizing a carboxylic acid monomer or copolymerizing two monomers, such as an unsaturated hydrophilic monomer and a hydrophilic oxyalkylated monomer. Examples of unsaturated hydrophilic monomers include acrylic acid, maleic acid, maleic anhydride, methacrylic acid, methacrylate esters and substituted methacrylate esters, vinyl acetate, vinyl alcohol, methylvinyl ether, crotonic acid, itaconic acid, vinyl acetic acid, and vinylsulphonate. The hydrophilic monomer may further be copolymerized with oxyalkylated monomers such as ethylene or propylene oxide. Preparation of oxyalkylated monomers is disclosed in U.S. Pat. Nos. 5,162,475 and 4,622,378. The hydrophilic oxyalkyated monomer preferably has a solubility of about 500 grams/liter, more preferably about 700 grams/liter in water. The unsaturated hydrophilic monomer may further be grafted with hydrophobic materials such as poly(alkene glycol) blocks. See, for example, materials discussed in U.S. Pat. Nos. 5,536,440, 5,147,576, 5,073,285, 5,534,183, and WO 03/054044.

Other polymeric polycarboxylates that are suitable include, for example, the polymers disclosed in U.S. Pat. No. 5,574,004. Such polymers include homopolymers and/or copolymers (composed of two or more monomers) of an alpha, beta-ethylenically unsaturated acid monomer such as acrylic acid, methacrylic acid, a diacid such as maleic acid, itaconic acid, fumaric acid, mesoconic acid, citraconic acid and the like, and a monoester of a diacid with an alkanol, e.g., having 1-8 carbon atoms, and mixtures thereof.

When the polymeric polycarboxylate is a copolymer, it can be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which can be either relatively non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide.

Copolymers of at least one unsaturated carboxylic acid monomer with at least one non-carboxylic comonomer should contain at least about 50 mol % of polymerized carboxylic acid monomer. The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions.

Saccharide Based Materials

The present composition may comprise a soil suspension polymer derived from saccharide based materials. Saccharide based materials may be natural or synthetic and include derivatives and modified saccharides. Suitable saccharide based materials include cellulose, gums, arabinans, galactans, seeds and mixtures thereof.

Saccharide derivatives may include saccharides modified with amines, amides, amino acids, esters, ethers, urethanes, alcohols, carboxylic acids, silicones, sulphonates, sulphates, nitrates, phosphates and mixtures thereof.

Modified celluloses and cellulose derivatives, such as carboxymethylcellulose, hydroxyethylcellulose, methyl cellulose, ethyl cellulose, cellulose sulphate, cellulose acetate (see U.S. Pat. No. 4,235,735), sulphoethyl cellulose, cyanoethyl cellulose, ethyl hydroxyethylcellulose, hydroxyethyl cellulose and hydroxypropylcellulose are suitable for use in the composition. Some modified celluloses are discussed in GB 1 534 641, U.S. Pat. No. 6,579,840 B1, WO 03/040279 and WO 03/01268.

Another preferred example of a saccharine based soil suspending polymer suitable for use in the present invention includes polyol compounds comprising at least three hydroxy moieties, preferably more than three hydroxy moieties, most preferably six or more hydroxy moieties. At least one of the hydroxy moieties further comprising an alkoxy moiety, the alkoxy moiety is selected from the group consisting of ethoxy (EO), propoxy (PO), butoxy (BO) and mixtures thereof preferably ethoxy and propoxy moieties, more preferably ethoxy moieties. The average degree of alkoxylation is from about 1 to about 100, preferably from about 4 to about 60, more preferably from about 10 to about 40. Alkoxylation is preferably block alkoxylation.

The polyol compounds useful in the present invention further have at least one of the alkoxy moieties comprising at least one anionic capping unit. Further modifications of the compound may occur, but one anionic capping unit must be present in the compound of the present invention. One embodiment comprises more than one hydroxy moiety further comprising an alkoxy moiety having an anionic capping unit. For example such as the shown in the formula:

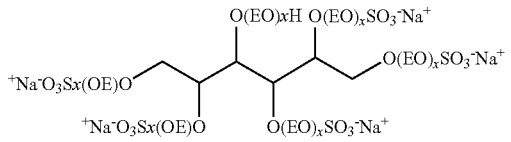

wherein x of the anionic capped polyol compound is from about 1 to about 100, preferably from about 10 to about 40.

Suitable anionic capping unit include sulfate, sulfosuccinate, succinate, maleate, phosphate, phthalate, sulfocarboxylate, sulfodicarboxylate, propanesultone, 1,2-disulfopropanol, sulfopropylamine, sulphonate, monocarboxylate, methylene carboxylate, ethylene carboxylate, carbonates, mellitic, pyromellitic, sulfophenol, sulfocatechol, disulfocatechol, tartrate, citrate, acrylate, methacrylate, poly acrylate, poly acrylate-maleate copolymer, and mixtures thereof. Preferably the anionic capping units are sulfate, sulfosuccinate, succinate, maleate, sulfonate, methylene carboxylate and ethylene carboxylate.

Suitable polyol compounds for starting materials for use in the present invention include maltitol, sucrose, xylitol, glycerol, pentaerythitol, glucose, maltose, matotriose, maltodextrin, maltopentose, maltohexose, isomaltulose, sorbitol, poly vinyl alcohol, partially hydrolyzed polyvinylacetate, xylan reduced maltotriose, reduced maltodextrins, polyethylene glycol, polypropylene glycol, polyglycerol, diglycerol ether and mixtures thereof. Preferably the polyol compound is sorbitol, maltitol, sucrose, xylan, polyethylene glycol, polypropylene glycol and mixtures thereof. Preferably the starting materials are selected from sorbitol, maltitol, sucrose, xylan, and mixtures thereof.

Modification of the polyol compounds is dependant upon the desired formulability and performance requirements. Modification can include incorporating anionic, cationic, or zwitterionic charges to the polyol compounds. In one embodiment, at least one hydroxy moiety comprises an alkoxy moiety, wherein at least one alkoxy moiety further comprises at least one anionic capping unit. In another embodiment, at least one hydroxy moiety comprises an alkoxy moiety, wherein the alkoxy moiety further comprises more than one anionic capping unit, wherein at least one anionic capping unit, but less than all anionic capping units, is then selectively substituted by an amine capping unit. The amine capping unit is selected from a primary amine containing capping unit, a secondary amine containing capping unit, a tertiary amine containing capping unit, and mixtures thereof.

The polyol compounds useful in the present invention further have at least one of the alkoxy moieties comprising at least one amine capping unit. Further modifications of the compound may occur, but one amine capping unit must be present in the compound of the present invention. One embodiment comprises more than one hydroxy moiety further comprising an alkoxy moiety having an amine capping unit. In another embodiment, at least one of nitrogens in the amine capping unit is quaternized. As used herein "quaternized" means that the amine capping unit is given a positive charge through quaternization or protonization of the amine capping unit. For example, bis-DMAPA contains three nitrogens, only one of the nitrogens need be quaternized. However, it is preferred to have all nitrogens quaternized on any given amine capping unit.

Suitable primary amines for the primary amine containing capping unit include monoamines, diamine, triamine, polyamines, and mixtures thereof. Suitable secondary amines for the secondary amine containing capping unit include monoamines, diamine, triamine, polyamines, and mixtures thereof. Suitable tertiary amines for the tertiary amine containing capping unit include monoamines, diamine, triamine, polyamines, and mixtures thereof.

Suitable monoamines, diamines, triamines or polyamines for use in the present invention include ammonia, methyl amine, dimethylamine, ethylene diamine, dimethylaminopropylamine, bis dimethylaminopropylamine (bis DMAPA), hexemethylene diamine, benzylamine, isoquinoline, ethylamine, diethylamine, dodecylamine, tallow triethylenediamine, mono substituted monoamine, monosubstituted diamine, monosubstituted polyamine, disubstituted monoamine, disubstituted diamine, disubstituted polyamine, trisubstituted triamine, tri substituted polyamine, multisubstituted polyamine comprising more than three substitutions provided at least one nitrogen contains a hydrogen, and mixtures thereof.

In another embodiment, at least one of nitrogens in the amine capping unit is quaternized. As used herein "quaternized" means that the amine capping unit is given a positive charge through quaternization or protonization of the amine capping unit. For example, bis-DMAPA contains three nitrogens, only one of the nitrogens need be quaternized. However, it is preferred to have all nitrogens quaternized on any given amine capping unit.

Modified Polyethyleneimine Polymer

The present composition may comprise a modified polyethyleneimine polymer. The modified polyethyleneimine polymer has a polyethyleneimine backbone having a molecular weight from about 300 to about 10000 weight average molecular weight, preferably from about 400 to about 7500 weight average molecular weight, preferably about 500 to about 1900 weight average molecular weight and preferably from about 3000 to 6000 weight average molecular weight.

The modification of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a $C_1$-$C_4$ alkyl, sulfates, carbonates, or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counter ion.

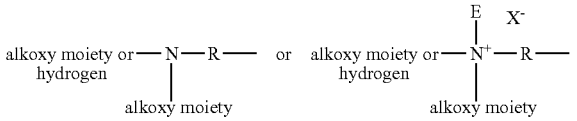

Also, for example, but not limited to, below is shown possible modifications to internal nitrogen atoms in the polyethyleneimine backbone where R represents an ethylene spacer and E represents a $C_1$-$C_4$ alkyl moiety and X— represents a suitable water soluble counter ion.

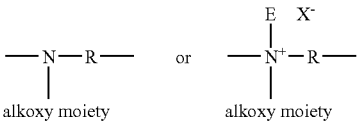

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Modified polyethyleneimine polymers are also described in U.S. Pat. No. 5,565,145.

Modified Hexamethylenediamine

The present composition may comprise a modified hexamentylenediamine. The modification of the hexamentylenediamine includes: (1) one or two alkoxylation modifications per nitrogen atom of the hexamentylenediamine. The alkoxylation modification consisting of the replacement of a hydrogen atom on the nitrogen of the hexamentylenediameine by a (poly)alkoxylene chain having an average of about 1 to about 40 alkoxy moieties per modification, wherein the terminal alkoxy moiety of the alkoxylene chain is capped with hydrogen, a $C_1$-$C_4$ alkyl, sulfates, carbonates, or mixtures thereof; (2) a substitution of one $C_1$-$C_4$ alkyl moiety and one or two alkoxylation modifications per nitrogen atom of the hexamentylenediamine. The alkoxylation modification consisting of the replacement of a hydrogen atom by a (poly)alkoxylene chain having an average of about 1 to about 40 alkoxy moieties per modification wherein the terminal alkoxy moiety of the alkoxylene chain is capped with hydrogen, a $C_1$-$C_4$ alkyl or mixtures thereof; or (3) a combination thereof. The alkoxylation may be in the form of ethoxy, propoxy, butoxy or a mixture thereof. U.S. Pat. No. 4,597,898, A preferred modified hexamethylenediamine has the general structure below:

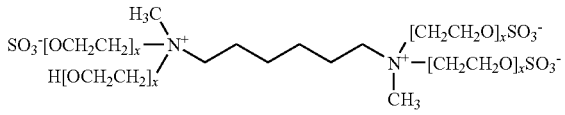

wherein x is from about 20 to about 30 and approximately 40% of the (poly)alkoxylene chain terminal alkoxy moieties are sulfonated.

A preferred modified hexamethylenediamine has the general structure below:

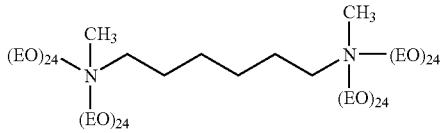

available under the tradename LUTENSIT® from BASF and such as those described in WO 01/05874.

Branched Polyaminoamines

A preferred example of a soil suspending polymer is exemplified in structural formula below:

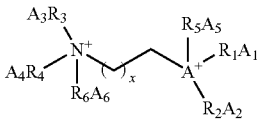

where x of the polyaminoamine can be from 1 to 12, more preferably from 1 to 8, more preferably from 1 to 6 and even more preferably from 1 to 4, $R_5$ and $R_6$ of the polyaminoamine may not be present (at which case N is neutral), and/or may be independently chosen from group of H, aliphatic $C_1$-$C_6$, alkylene $C_2$-$C_6$, arylene, or alkylarylene, $R_1$, $R_2$, $R_3$, and $R_4$ of the polyaminoamine are independently chosen from the group of H, OH, aliphatic $C_1$-$C_6$, alkylene $C_2$-$C_6$, arylene, or alkylarylene, preferably at least one or more block of polyoxyalkylene $C_2$-$C_5$, and single and/or repeating block units of linear or branched alkylene ($C_1$-$C_{20}$), linear or branched oxyalkylene ($C_2$-$C_5$) and mixtures of thereof. $A_1$, $A_2$, $A_3$, $A_4$, $A_5$, and $A_6$ of the polyaminoamine are capping groups independently selected from hydrogen, hydroxy, sulfate, sulfonate, carboxylate, phosphate, and mixtures thereof. If $R_1$, $R_2$, $R_3$, or $R_4$ are $N(CH_2)_xCH_2$, than it represent continuation of this structure by branching. See also U.S. Pat. Nos. 4,597,898; 4,891,160; 5,565,145; and 6,075,000. The average degree of alkoxylation can also be more than 7, preferably from about 7 to about 40.

Modified Polyaminoamide

Modified polyaminoamides, such as the ones discussed in US 2005/0209125 A1, may be utilized as a soil suspending polymer. Suitable modified polyaminoamides have, depending on their degree of alkoxylation, a number average molecular weight ($M_n$) of from 1,000 to 1,000,000, preferably from 2,000 to 1,000,000 and more preferably from 2,000 to 50,000.

One embodiment of a modified polyaminoamide has the formula:

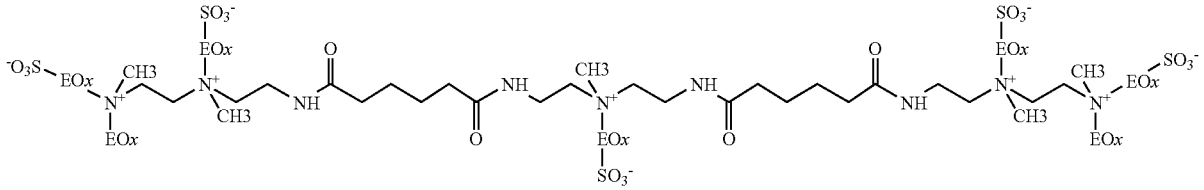

wherein x of the polyaminoamide is from 10 to 200, preferably from about 15 to about 150, most preferably from about 21 to about 100. Most preferably the number average of x of the polyaminoamide ranges from 15 to 70, especially 21 to 50. EO in the polyaminoamide represents ethoxy moieties.

In another preferred embodiment, the detergent composition comprises a modified polyaminoamide wherein the ratio of dicarboxylic acid:polyalkylenepolyamines is 4:5 and 35:36; the polyalkylenepolyamine is quaternized as described in formula (a), (b1) and (b2) above.

Hydrophobic Polyamine Ethoxylate Polymers

Soil suspending polymer for the composition may include hydrophobic polyamine ethoxylate polymers characterized by comprising a general formula:

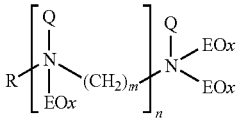

R of the hydrophobic polyamine ethoxylate polymer is a linear or branched $C_1$-$C_{22}$ alkyl, a linear or branched $C_1$-$C_{22}$ alkoxyl, linear or branched $C_1$-$C_{22}$ acyl, and mixtures thereof; if R is selected as being branched, the branch may comprise from 1 to 4 carbon atoms; preferably R of the hydrophobic polyamine ethoxylate polymer is a linear $C_{12}$ to $C_{18}$ alkyl. The alkyl, alkoxyl, and acyl may be saturated or unsaturated, preferably saturated. The n index of the hydrophobic polyamine ethoxylate polymer is from about 2 to about 9, preferably from about 2 to about 5, most preferably 3.

Q of the hydrophobic polyamine ethoxylate polymer is independently selected from an electron pair, hydrogen, methyl, ethyl, and mixtures thereof. If the formulator desires a neutral backbone of the hydrophobic polyamine ethoxylate, Q of the hydrophobic polyamine ethoxylate polymer should be selected to be an electron pair or hydrogen. Should the formulator desire a quaternized backbone of the hydrophobic polyamine ethoxylate; at least on Q of the hydrophobic polyamine ethoxylate polymer should be chosen from methyl, ethyl, preferably methyl.

The m index of the hydrophobic polyamine ethoxylate polymer is from 2 to 6, preferably 3. The index x of the hydrophobic polyamine ethoxylate polymer is independently selected to average from about 1 to about 70 ethoxy units, preferably an average from about 20 to about 70, preferably about 30 to about 50, for polymers containing non-quaternized nitrogens; preferably from about 1 to about 10 for polymers containing quaternized nitrogens.

The ethoxy units of the hydrophobic polyamine ethoxylate may be further modified by independently adding an anionic capping unit to any or all ethoxy units. Suitable anionic capping units include sulfate, sulfosuccinate, succinate, maleate, phosphate, phthalate, sulfocarboxylate, sulfodicarboxylate, propanesultone, 1,2-disulfopropanol, sulfopropylamine, sulphonate, monocarboxylate, methylene carboxylate, carbonates, mellitic, pyromellitic, citrate, acrylate, methacrylate, and mixtures thereof. Preferably the anionic capping unit is a sulfate.

In another embodiment, the nitrogens of the hydrophobic polyamine ethoxylate polymer are given a positive charge through quaternization. As used herein "quaternization" means quaternization or protonization of the nitrogen to give a positive charge to the nitrogens of the hydrophobic polyamine ethoxylate.

Polyamino Acids

The soil suspending polymers can be derived from L-glumatic acid, D-glumatic acid or mixtures, e.g. racemates, of these L and D isomers. The polymers include not only the homopolymers of glutamic acid but also copolymers, such as block, graft or random copolymers, containing glutamic acid. These include, for example, copolymers containing at least one other amino acid, such as aspartic acid, ethylene glycol, ethylene oxide, (or an oligimer or polymer of any of these) or polyvinyl alcohol. Glutamic acid can, of course, carry one or more substituents including, for example, alkyl, hydroxy alkyl, aryl and arylalkyl, commonly with up to 18 carbon atoms per group, or polyethylene glycol attached by ester linkages. See U.S. Pat. No. 5,470,510 A, issued Nov. 28, 1995.

Polyamine N-Oxide Polymers

The polyamine N-oxide polymers suitable for use herein contain a polymerisable unit, whereto an N-oxide group can be attached to or wherein the N-oxide group forms part of the polymerisable unit or a combination of both. Suitable polyamine N-oxides wherein the N-oxide group forms part of the polymerisable unit comprise polyamine N-oxides wherein the N-oxide group comprises part of a heterocyclic group such as pyridine, pyrrole, imidazole, pyrrolidine, piperidine, quinoline, acridine and derivatives thereof. Another class of said polyamine N-oxides comprises the group of polyamine N-oxides wherein the N-Oxide group is attached to the polymerisable unit. Preferred class of these polyamine N-oxides are the polyamine N-oxides.

Any polymer backbone can be used as long as the amine oxide polymer formed has dye transfer inhibiting properties. Examples of suitable polymeric backbones are polyvinyls, polyalkylenes, polyesters, polyethers, polyamide, polyimides, polyacrylates and mixtures thereof. The amine N-oxide polymers of the present invention typically have a ratio of amine to the amine N-oxide of about 10:1 to about 1:1000000. However the amount of amine oxide groups present in the polyamine oxide polymer can be varied by appropriate copolymerization or by appropriate degree of N-oxidation. Preferably, the ratio of amine to amine N-oxide is from about 2:3 to about 1:1000000; from about 1:4 to about 1:1000000; and from about 1:7 to about 1:1000000. The soil suspending polymers encompass random or block copolymers where one monomer type is an amine N-oxide and the other monomer type is either an amine N-oxide or not. The amine oxide unit of the polyamine N-oxides has a pKa<10, pKa<7, and pKa<6. The polyamine oxides can be obtained in almost any degree of polymerization. The degree of polymerization is not critical provided the material has the desired soil-suspending power. Typically, the average molecular weight is within the range of about 500 to about 1,000,000; from about 1,000 to about 50,000, from about 2,000 to about 30,000, and from about 3,000 to about 20,000.

N-Vinylimidazole N-Vinylpyrrolidone Copolymers

Suitable soil suspending polymers for use in the cleaning compositions are selected from N-vinylimidazole N-vinylpyrrolidone copolymers wherein a molar ratio of N-vinylimidazole to N-vinylpyrrolidone from about 1 to about 0.2, from about 0.8 to about 0.3, and from about 0.6 to about 0.4 and said polymer has an average molecular weight range from about 5,000 to about 50,000; from about 8,000 to about 30,000; and from about 10,000 to about 20,000. The average molecular weight range was determined by light scattering as described in Barth H. G. and Mays J. W. Chemical Analysis Vol 113, "Modern Methods of Polymer Characterization".

Polyvinylpyrrolidone

Another suitable soil suspending polymer for use herein comprise a polymer selected from polyvinylpyrrolidone ("PVP") having an average molecular weight from about 2,500 to about 400,000 can also be utilized; from about 5,000 to about 200,000; from about 5,000 to about 50,000; and from about 5,000 to about 15,000 can also be utilized. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan® HP 165 and Sokalan® HP 12; polyvinylpyrrolidones known to persons skilled in the detergent field (see for example EP-A-262,897 and EP-A-256,696).

Polyvinyloxazolidone and Polyvinylimidazole

Other suitable soil suspending polymers for use herein include polyvinyloxazolidone having an average molecular weight from about 2,500 to about 400,000 and polyvinylimidazole having an average molecular weight from about 2,500 to about 400,000.

Surfactants

Surfactant that may be used for the present invention may comprise a surfactant or surfactant system comprising surfactants selected from nonionic, anionic, cationic surfactants, ampholytic, zwitterionic, semi-polar nonionic surfactants, other adjuncts such as alkyl alcohols, or mixtures thereof.

The detergent composition of the present invention further optionally comprises from about 0.1% to about 20%, preferably from about 0.2% to about 10%, more preferably from about 0.2% to about 5% by weight of the detergent composition of a surfactant system having one or more surfactants.

Anionic Surfactants

Nonlimiting examples of anionic surfactants useful herein include: $C_8$-$C_{18}$ alkyl benzene sulfonates (LAS); $C_{10}$-$C_{20}$ primary, branched-chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; mid-chain branched alkyl sulfates as discussed in U.S. Pat. Nos. 6,020,303 and 6,060,443; mid-chain branched alkyl alkoxy sulfates as discussed in U.S. Pat. Nos. 6,008,181 and 6,020,303; modified alkylbenzene sulfonate (MLAS) as discussed in WO 99/05243, WO 99/05242, and WO 99/05244; methyl ester sulfonate (MES); and alpha-olefin sulfonate (AOS).

Nonionic Co-Surfactants

Non-limiting examples of nonionic co-surfactants include: $C_{12}$-$C_{18}$ alkyl ethoxylates, such as, NEODOL® nonionic surfactants from Shell and LUTENSOL® XL and LUTENSOL® XP from BASF; $C_6$-$C_{12}$ alkyl phenol alkoxylates wherein the alkoxylate units are a mixture of ethoxy and propoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. Nos. 6,153,577, 6,020,303 and 6,093,856; Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. Nos. 4,681,704, and 4,133,779.

Optional Components

The detergent compositions of the present invention can also include any number of additional optional ingredients. These include conventional laundry detergent composition components such as a liquid carrier, detersive builders, enzymes, enzyme stabilizers (such as propylene glycol, boric acid and/or borax), chelating agents, suds suppressors, other fabric care benefit agents, pH adjusting agents, smectite clays, structuring agents, dye transfer inhibiting agents, anti-deposition agents, soil suspension polymers, soil release polymers, optical brighteners, perfumes and coloring agents. These also include conventional dish cleaning composition components such as liquid carrier, silicates, zinc containing compounds for glass care, phosphated builders, suds suppressors, enzymes, enzyme stabilizers (such as boric acid and/or borax), chelating agents, structuring agents, perfumes and coloring agents. The various optional detergent composition ingredients, if present in the compositions herein, should be utilized at concentrations conventionally employed to bring about their desired contribution to the detergent composition or the laundering operation. Frequently, the total amount of such optional detergent composition ingredients can range from about 0.5% to about 50%, more preferably from about 1% to about 40%, by weight of the composition.

Liquid Carrier

The liquid detergent compositions according to the present invention also contain a liquid carrier. Generally the amount of the liquid carrier employed in the compositions herein will be relatively large, often comprising the balance of the detergent composition, but can comprise from about 5 wt % to about 85 wt % by weight of the detergent composition. Preferably, the compositions of the present invention comprise from about 20% to about 80% of an aqueous liquid carrier.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such $C_1$-$C_3$ lower alkanols such as methanol, ethanol and/or propanol, diols, other polyols, ethers, $C_1$-$C_3$ alkanolamines such as mono-, di- and triethanolamines, and the like, have been conventionally been added to liquid detergent compositions as hydrotropes, co-solvents or stabilizers. Thickeners, if desired, may also be utilized, such as Polygel DKP®, a polyacrylate thickener from ex 3V Co. If utilized, phase stabilizers/co-solvents can comprise from about 0.1% to 5.0% by weight of the compositions herein.

Enzymes

Enzymes can be included in effective amounts in the liquid laundry detergent composition herein for a wide variety of fabric laundering purposes, including removal of protein-based, carbohydrate-based, or triglyceride-based stains, for example, and/or for fabric restoration. As used herein, an "effective amount" is an amount of additional enzyme to achieve the desired removal of a stain or amount of fabric restoration.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or combinations thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on.

A potential enzyme combination comprises a cocktail of conventional detersive enzymes like protease, lipase, cutinase and/or cellulase in conjunction with amylase. Detersive enzymes are described in greater detail in U.S. Pat. No. 6,579,839. Particularly preferred compositions herein contain from about 0.05% to about 2% by weight of detersive enzymes.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01% to 1% by weight of a commercial enzyme preparation. Protease enzymes are usually present in such commercial preparations at levels sufficient to provide from 0.005 to 0.1 Anson units (AU) of activity per gram of composition.

Enzyme materials useful for liquid detergent formulations, and their incorporation into such formulations, are disclosed in U.S. Pat. No. 4,261,868, Hora et al, and in U.S. Pat. No. 4,507,219, Hughes.

Enzyme Stabilizer

If an enzyme or enzymes are included in the compositions of the present invention, it is preferred that the composition also contain an enzyme stabilizer. Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds (i.e., certain esters, diakyl glycol ethers, alcohols or alcohol alkoxylates), alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compounds, polyamide oligomer, glycolic acid or its salts; poly hexa methylene biguanide or N,N-bis-3-amino-propyl-dodecyl amine or salt; and mixtures thereof. See also U.S. Pat. No. 3,600,319, Gedge, et al., EP 0 199 405 A, Venegas, U.S. Pat. Nos. 3,519,570 and 4,537,706 (borate species).

Typical detergents, especially liquids, will comprise from about 1 to about 30, preferably from about 2 to about 20, more preferably from about 5 to about 15, and most preferably from about 8 to about 12, millimoles of calcium ion per liter of finished composition to provide enzyme stability. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. Accordingly, as a general proposition the compositions herein will typically comprise from about 0.05% to about 2% by weight of the detergent composition of a water-soluble source of calcium or magnesium ions, or both.

In a liquid composition, the degradation by the proteolytic enzyme of second enzymes can be avoided by protease reversible inhibitors such as peptide or protein type, in particular the modified subtilisin inhibitor of family VI and the plasminostrepin; leupeptin, peptide trifluoromethyl ketones, peptide aldehydes.

Chelating Agents

Chelating agents useful herein are selected from all compounds in any suitable amount or form that control the adverse effects of heavy metal contamination or water hardness (for example, calcium and magnesium ions) in an aqueous bath by binding with metal ions. Any ligand with multidentate is suitable as a chelating agent. For example, suitable chelating agents can include, but are not limited to, carboxylates, phosphates, phosphonates, polyfunctionally-substituted aromatic compounds, polyamines, biodegradable compounds, the alkali metal, ammonium or substituted ammonium salts or complexes of these chelating agents, and mixtures thereof. Further examples of suitable chelating agents and levels of use are described in U.S. Pat. Nos. 3,812,044; 4,704,233; 5,292,446; 5,445,747; 5,531,915; 5,545,352; 5,576,282; 5,641,739; 5,703,031; 5,705,464; 5,710,115; 5,710,115; 5,712,242; 5,721,205; 5,728,671; 5,747,440; 5,780,419; 5,879,409; 5,929,010; 5,929,018; 5,958,866; 5,965,514; 5,972,038; 6,172,021; and 6,503,876.

The chelating agents, when present, may comprise from 0.1% to about 5%, 0.25% to 3% by weight of the composition.

Methods

The present invention includes a method for cleaning a surface or fabric. Such method includes the steps of contacting an esterified substituted benzene sulfonate of the present invention or an embodiment of the detergent composition comprising the esterified substituted benzene sulfonate of the present invention, in neat form or diluted in a wash liquor, with at least a portion of a surface or fabric then optionally rinsing such surface or fabric. Preferably the surface or fabric is subjected to a washing step prior to the aforementioned optional rinsing step. For purposes of the present invention, washing includes but is not limited to, scrubbing, and mechanical agitation.

As will be appreciated by one skilled in the art, the detergent compositions of the present invention are ideally suited for use in home care (hard surface detergent compositions), personal care and/or laundry applications. Accordingly, the present invention includes a method for cleaning a surface and/or laundering a fabric. The method comprises the steps of contacting a surface and/or fabric to be cleaned/laundered with the esterified substituted benzene sulfonate or a detergent composition comprising the esterified substituted benzene sulfonate. The surface may comprise most any hard surface being found in a typical home such as hard wood, tile, ceramic, plastic, leather, metal, glass, or may consist of cleaning surfaces in a personal care product such as hair and skin. The surface may also include dishes, glasses, and other cooking surfaces. The fabric may comprise most any fabric capable of being laundered in normal consumer use conditions.

The detergent composition solution pH is chosen to be the most complimentary to a surface to be cleaned spanning broad range of pH, from about 5 to about 11. For personal care such as skin and hair cleaning pH of such composition preferably has a pH from about 5 to about 8 for laundry detergent compositions pH of from about 8 to about 10. The compositions are preferably employed at concentrations of from about 200 ppm to about 10,000 ppm in solution. The water temperatures preferably range from about 5° C. to about 100° C.

For use in laundry detergent compositions, the compositions are preferably employed at concentrations from about 200 ppm to about 10000 ppm in solution (or wash liquor). The water temperatures preferably range from about 5° C. to about 60° C. The water to fabric ratio is preferably from about 1:1 to about 20:1.

The composition described herein can be used for the cleaning of soiled dishes by contacting the composition with a dish surface and then rinsing the dish surface with water. Optionally the dishes are allowed to dry either by heat or by air drying. Preferably the dishes are placed into an automatic dishwashing unit. The automatic dishwashing composition suitable herein can be dispensed from any suitable device, including but not limited to: dispensing baskets or cups, bottles (pump assisted bottles, squeeze bottles, etc.), mechanic pumps, multi-compartment bottles, capsules, multi-compartment capsules, paste dispensers, and single- and multi-compartment water-soluble pouches, and combinations thereof. For example, a multi-phase tablet, a water-soluble or water-dispersible pouch, and combinations thereof, may be used to deliver the composition to the desired dish surface.

As will be appreciated by one skilled in the art, the detergent compositions of the present invention are also suited for use in personal cleaning care applications. Accordingly, the present invention includes a method for cleaning skin or hair. The method comprises the steps of contacting a skin/hair to be cleaned with a cleaning solution or nonwoven substrate impregnated with an embodiment of Applicants' detergent composition. The method of use of the nonwoven substrate when contacting skin and hair may be by the hand of a user or by the use of an implement to which the nonwoven substrate attaches.

TABLE 1

Granular Laundry Detergents

| | Formulations | | | | | |
|---|---|---|---|---|---|---|
| | A (wt %) | B (wt %) | C (wt %) | D (wt %) | E (wt %) | F (wt %) |
| $C_{11-12}$ linear alkyl benzene sulfonate | 0.073 | 0.01 | 7.0 | 19 | 18 | 21 |
| Mid-branched $C_{16-18}$ is alkyl sulfate[1] | 10.7 | 10.2 | — | — | — | — |
| $C_{14-15}$ alkyl sulfate | 4.6 | 4.0 | 0.78 | 1 | 1.1 | 0.9 |
| $C_{14-15}$ alkyl ethoxy ($EO_7$) alcohol | — | — | 3.0 | — | — | — |
| $C_{14-15}$ alkyl ethoxy ($EO_3$) alcohol | — | — | — | 0.3 | 0.3 | 0.2 |
| $C_{8-10}$ alkyl dimethyl ethoxy amine | — | — | 0.92 | — | — | — |
| Zeolite A | 27 | 23 | 15 | 10.5 | 10 | 14 |
| Carbonate | 25 | 33 | 13 | 21 | 19 | 21 |
| Citric acid | — | — | 2.8 | — | — | — |
| Sodium percarbonate | 3.0 | 5.6 | 13.0 | 4.5 | 4.8 | 0.5 |
| Sodium sulfate | 14 | 10 | 29 | 22 | 24 | 11 |
| Magnesium Sulfate | — | — | 0.7 | — | — | — |

TABLE 1-continued

| Granular Laundry Detergents | Formulations | | | | | |
|---|---|---|---|---|---|---|
| | A (wt %) | B (wt %) | C (wt %) | D (wt %) | E (wt %) | F (wt %) |
| Esterified substituted benzene sulfonate[2] | 0.1-4% | 0.1-4% | 0.1-4% | 0.1-4% | 0.1-4% | 0.1-4% |
| Soil suspending polymer[3] | 0.1-6% | 0.1-6% | 0.1-6% | 0.1-6% | 0.1-6% | 0.1-6% |
| Carboxy methyl cellulose | — | — | 0.18 | — | — | — |
| S,S-(ethylenediamine N,N'-disuccinic acid) | — | — | 0.20 | — | — | — |
| Polyethylene glycol | 1.2 | 0.7 | — | 0.4 | 0.4 | — |
| Diethylene triamine penta acetate | 0.7 | — | — | — | — | — |
| Bleach[4] | 1.9 | 0.4 | 3.5 | 2.5 | 3.7 | — |
| Enzyme[5] | 0.13 | 0.13 | 0.6 | 0.2 | 0.5 | 0.2 |
| Imidazole-epichlorhydrin | 0.15 | — | — | — | — | — |
| Smectite/montmorillonite clay | — | — | — | — | — | 16 |
| Hydrotrope | — | — | — | 1.7 | 1.6 | 0.5 |
| Perfume, dye, brightener, processing aids, other optional components and water | Balance to 100% | Balance to 100% | Balance to 100% | Balance to 100% | Balance to 100% | Balance to 100% |

[1]such as those described in U.S. Pat. No. 6,020,303 and U.S. Pat. No. 6,060,443
[2]such as those described above
[3]such as acrylic acid/maleic acid copolymer, hexamentylene diamine ethoxylate and/or polyacrylate polymer described above.
[4]NOBS and/or TAED.
[5]one or more enzymes such as protease, mannaway, natalase, lipase and mixture thereof.

TABLE II

| Liquid laundry detergents | G (wt %) | H (wt %) |
|---|---|---|
| $C_{12-15}$ alkyl ethoxy ($EO_{1.8}$) sulfate | 11.00 | 12.65 |
| Sodium formate | 1.60 | 0.09 |
| Sodium hydroxide | 2.3 | 3.8 |
| Monoethanolamine | 1.40 | 1.49 |
| Diethylene glycol | 5.5 | 0.0 |
| $C_{12-13}$ ethoxylated ($EO_9$) alcohol | 0.4 | 0.6 |
| Diethylene triamine penta acetate MW = 393 | 0.15 | 0.15 |
| $C_{11-12}$ linear alkyl benzene sulfonate | 4.0 | 6.6 |
| Citric Acid | 0-4% | 0-4% |
| $C_{12-14}$ dimethyl Amine Oxide | 0.30 | 0.73 |
| $C_{12-18}$ Fatty Acid | 0.8 | 1.9 |
| Borax | 1.43 | 1.50 |
| Ethanol | 1.54 | 1.77 |
| Esterified substituted benzene sulfonate[1] | 0.1-6% | 0.1-6% |
| Soil suspending polymer[2] | 0.2-12% | 0.2-12% |
| Sodium Percarbonate | 0.5-15% | 0.5-15% |
| 1,2-Propanediol | 0.0 | 6.6 |
| Enzyme*[3] | 1.0-37.0 | 1.0-37.0 |
| Water, perfume, dyes & other components | Balance to 100% | Balance to 100% |

[1]such as those described above
[2]a water soluble soil suspending polymer such as described in U.S. Pat. No. 4,597,898, U.S. Pat. No. 5,565,145, available under the tradename LUTENSIT ® from BASF and such as those described in WO 01/05874.
[3]one or more enzymes such as protease, mannaway, natalase, lipase and mixture thereof.
*Numbers quoted in mg enzyme/100 g TABLE III-continued

| Automatic Dishwashing Cleaning composition | Gel (wt %) | Powder (wt %) |
|---|---|---|
| Esterified substituted benzene sulfonate[4] | 0.1-6 | 0.1-6 |
| Soil suspending polymer[5] | 0.2-6 | 0.2-6 |
| Hydrozincite | 0-0.3 | — |
| Zinc sulfate | 0-0.8 | — |
| Nitric acid (70%) | 0.01-0.05 | — |
| Sulfuric acid | 0-5 | — |
| NaOH | 0-4 | — |
| KOH | 0-15 | — |
| Carbonate | — | 25-35 |
| 2.0r silicate | 0-20 | 7-15 |
| Sodium hypochloride | 0-8 | — |
| Enzyme system[6] | 0-1 | 0.5-3 |
| 1,2-propanediol | 0-1 | — |
| Boric acid | 0-4 | — |
| Sodium perborate monohydrate | 2-6 | 2-6 |
| Calcium chloride | 0-0.5 | — |
| Sodium benzoate | 0.1-6 | — |
| Sodium sulfate | — | 20-35 |
| Water, perfume and other components | Balance to 100% | Balance to 100% |

[1]polyacrylate thickener from ex 3V Co.
[2]linear alcohol ethoxylate from Olin Corporation
[3]sulfonated copolymer of acrylic acid from Alco Chemical Co.
[4]such as those described above
[5]a soil suspending polymer such as those described above
[6]one or more enzymes such as protease, mannaway, natalase, lipase and mixture thereof.

TABLE III

| Automatic Dishwashing Cleaning composition | Gel (wt %) | Powder (wt %) |
|---|---|---|
| STPP | 10-25 | 10-30 |
| Polygel DKP[1] | 1-2 | — |
| SLF-18 poly-tergent[2] | 0-2 | 0.5-2 |
| Alcosperse 246[3] | — | 0-5 |

TABLE IV

| Automatic Dishwashing Two-Phase Composition Unit Dose | Powder (wt % based on 19 g portion) |
|---|---|
| STPP | 34-38 |
| Alcosperse[1] | 7-12 |
| SLF-18 Polytergent[2] | 1-2 |

TABLE IV-continued

| Automatic Dishwashing Two-Phase Composition Unit Dose | |
|---|---|
| Esterified substituted benzene sulfonate[3] | 0.1-6.0 |
| Soil suspending polymer[4] | 0.2-6.0 |
| Sodium perborate monohydrate | 2-6 |
| Carbonate | 20-30 |
| 2.0r silicate | 5-9 |
| Sodium disilicate | 0-3 |
| Enzyme system[5] | 0.1-5.0 |
| Pentaamine cobalt(III)chloride dichloride salt | 10-15 |
| TAED | 0-3 |
| Perfume, dyes, water and other components | Balance to 100% |
| | Liquid (wt % based on 1.9 g portion) |
| Dipropylene Glycol | 35-45 |
| SLF-19 Polytergent[2] | 40-50 |
| Neodol ® C11EO9 | 1-3 |
| Dyes, water and other components | Balance to 100% |

[1]such as Alcosperse ® 246 or 247, a sulfonated copolymer of acrylic acid from Alco Chemical Co.
[2]linear alcohol ethoxylate from Olin Corporation
[3]such as those described above
[4]a soil suspending polymer such as those described above
[5]one or more enzymes such as protease, mannaway, natalase, lipase and mixture thereof All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

(a) an esterified benzene sulfonate having the general structure:

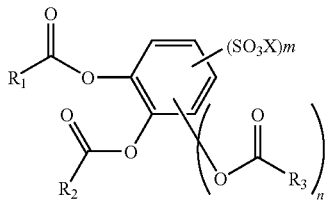

wherein $R_1$ is selected from hydrogen or a $C_1$-$C_{11}$ alkyl; $R_2$ is selected from hydrogen or a $C_1$-$C_{11}$ alkyl, $R_3$ is selected from hydrogen or a $C_1$-$C_{11}$ alkyl, m is selected from 1 or 2, n is selected from 0 to 3, and X is a suitable water soluble cation;

(b) a water soluble soil suspending polymer; and (c) a hydrogen peroxide source.

2. The detergent composition of claim 1 wherein the esterified substituted benzene sulfonate is essentially free of 1,2-benzenediol.

3. The detergent composition of claim 1 wherein the esterified benzene sulfonate is selected as:

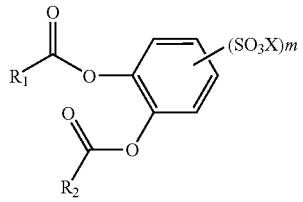

wherein $R_1$ is selected from hydrogen or a $C_1$-$C_{11}$ alkyl; $R_2$ is selected from hydrogen or a $C_1$-$C_{11}$ alkyl, m is selected from 1 or 2, wherein the sulfonate moieties may be located on the 1, 2, 3, or 6 positions on the benzene ring and X is a suitable water soluble cation.

4. The detergent composition of claim 1 wherein the esterified benzene di-sulfonate is selected such that $R_1$ and $R_2$ are either a $C_1$ alkyl or $C_9$ alkyl, or mixtures thereof.

5. The detergent composition of claim 1 wherein the esterified benzene di-sulfonate is selected such that The sulfonate moieties are located at the 1 and 3 position and X is a sodium cation.

6. The detergent composition of claim 1 wherein The esterified benzene sulfonate is a mixture of a first esterified benzene sulfonate and a second esterified benzene sulfonate wherein the first esterified benzene sulfonate comprises $R_1$ selected as a $C_1$ alkyl and $R_2$ selected as a $C_9$ alkyl; and wherein the second esterified benzene sulfonate comprises both $R_1$ and $R_2$ selected as $C_9$ alkyl.

7. The detergent composition of claim 1 wherein the hydrogen peroxide source is selected from the group consisting of percarbonate, perborate, persilicate, hydrogen peroxide adducts, hydrogen peroxide and mixtures thereof.

8. The detergent composition of claim 1 wherein the water soluble soil suspending polymer is selected from the group comprising polyesters, polycarboxylates, saccharide based materials, modified cellulloses, modified polyethyleneimines, modified hexamethylenediamine, polyamidoamines, branched polyaminoamines, hydrophobic polyamine ethoxylate polymers, polyamino acids, polyvinylpyridine N-oxide, N-vinylimidazole N-vinylpyrrolidone copolymers, polyvinylpyrrolidone, polyvinyloxazolidone, polyvinylimidazole and mixtures thereof.

9. A soil cleaning system comprising (a) an esterified benzene sulfonate having the structure:

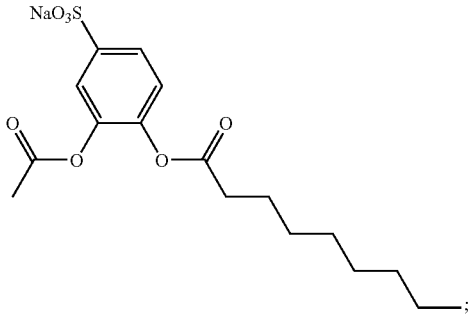

;

(b) a hydrogen peroxide source; and (c) a water soluble soil suspending polymer.

10. The detergent composition of claim 1 further comprising from about 0.1% to about 50%, by weight of the detergent composition of a surfactant system having one or more surfactants.

11. The detergent composition of claim 1 further comprising from about 0.01 mg to about 3 mg, of active enzyme per gram of the composition of an enzyme.

12. The detergent composition of claim 1 further comprising a chelating agent other than a catechol having one or more sulfonate groups.

13. A method for cleaning a surface or fabric including the steps of:

(a) contacting the esterified substituted benzene sulfonate of claim 1 or the detergent composition comprising the esterified substituted benzene sulfonate of claim 6, in neat form or diluted in a wash liquor, with at least a portion of a surface or fabric;

(b) optionally subjecting the surface or fabric to a washing;

(c) rinsing the surface or fabric.

* * * * *